United States Patent [19]

Shinohara

[11] 4,015,424

[45] Apr. 5, 1977

[54] COMBUSTION ENGINE WITH DUAL FUNCTION MOTOR ELEMENT AND ROTARY VALVE FOR CYCLICAL FUEL AND EXHAUST METERING

[76] Inventor: Sakuta Shinohara, No. 52-6, 1-chome, Hohnan, Suginami, Tokyo, Japan

[22] Filed: Apr. 11, 1975

[21] Appl. No.: 567,191

[52] U.S. Cl. ..... 60/39.6; 60/39.61; 60/39.63; 60/39.71; 60/39.81

[51] Int. Cl.[2] ..... F02G 3/00; F02G 3/02

[58] Field of Search ..... 60/39.6, 39.63, 39.82 N, 60/39.61, 39.69, 39.71, 39.81, 39.39

[56] References Cited

UNITED STATES PATENTS

| | | | |
|---|---|---|---|
| 324,828 | 8/1885 | Gassett | 60/39.82 N |
| 421,477 | 2/1890 | Beckfeld et al. | 60/39.82 N |
| 2,131,216 | 9/1938 | Brooke | 60/39.6 |
| 3,040,530 | 6/1962 | Yalnizyan | 60/39.61 |
| 3,407,596 | 10/1968 | Dasbach et al. | 60/39.71 |
| 3,623,317 | 11/1971 | Foster-Pegg | 60/39.46 |
| 3,877,220 | 4/1975 | Girodin | 60/39.63 |
| 3,879,938 | 4/1975 | Rinker et al. | 60/39.61 |
| 3,886,734 | 6/1975 | Johnson | 60/39.61 |

*Primary Examiner*—William L. Freeh
*Assistant Examiner*—Thomas I. Ross
*Attorney, Agent, or Firm*—Bucknam and Archer

[57] ABSTRACT

An internal combustion engine comprises a compression and expansion casing having an operating member adapted to cause volumetric compression of fuel mixture and volumetric expansion of combustion gas and a combustion tube in which combustion of fuel mixture is effected at a constant pressure. The compression and expansion casing also has means communicating with the interior thereof for providing fuel mixture thereto. The combustion tube includes a constant-pressure chamber adapted to communicate with the interior of the compression and expansion casing through a first valve which opens only when the fuel mixture within the compression and expansion casing is in a compressed condition, a combustion-sustaining chamber communicating with the constant-pressure chamber and having an igniter for igniting and sustaining combustion of fuel mixture and a constant-pressure combustion chamber communicating with the combustion-sustaining chamber to cause further complete combustion of the combustion gas from the combustion-sustaining chamber. The constant-pressure combustion chamber is adapted to communicate with the interior of the compression and expansion casing through a second valve which opens only when the operating member of the compression and expansion casing is in an initial portion of its expansion stroke.

3 Claims, 7 Drawing Figures

FIG. 5
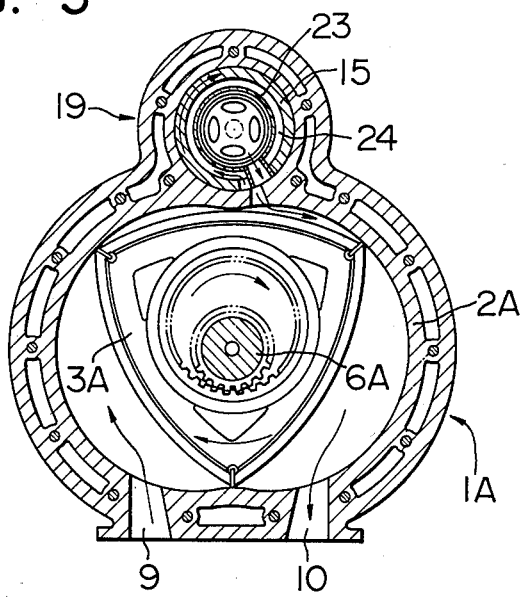
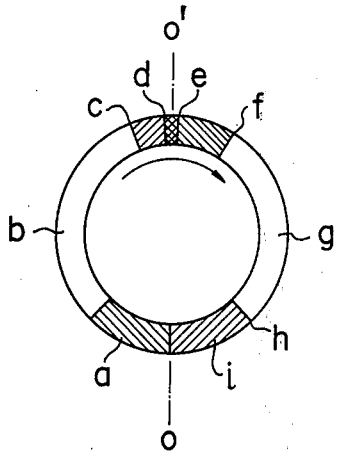
FIG. 6
FIG. 7
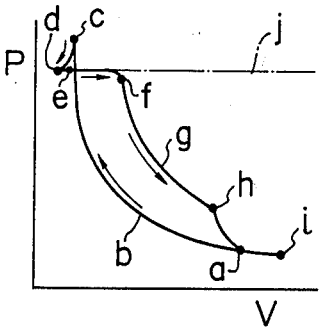

COMBUSTION ENGINE WITH DUAL FUNCTION MOTOR ELEMENT AND ROTARY VALVE FOR CYCLICAL FUEL AND EXHAUST METERING

BACKGROUND OF THE INVENTION

1. Field of the Invention

This invention relates to an internal combustion engine and, more particularly, to an internal combustion engine suitable especially for combustion of fuel mixtue having a lower fuel-air ratio.

2. Description of the Prior Art

Among the most reliable measures to reduce the amount of poisonous gases as produced during combustion of fuel in conventional internal combustion engines, there has been proposed a fuel combustion system wherein a fuel mixture having a lower fuel-air ratio is used. However, in conventional internal combustion engines, it is apparent that the lower the fuel-air ratio of the fuel mixture used is, the more difficult its combustion is. To solve this problem, a so-called stratified charge combustion system has been proposed in which fuel mixture is supplied to an internal combustion engine so that the concentration of fuel mixture in a layer about the igniter of the engine may be higher than that of fuel mixture in layers more remote from the igniter. However, for example, in certain engines embodying such a stratified charge combustion system and having a sub-combustion chamber for combustion of the higher density portion of stratified fuel mixture, an amount of polluting exhaust gas proportional to the volume of the sub-combustion chamber is necessarily generated. Therefore, this stratified charge system is not considered to be a complete unpolluting combustion system.

Furthermore, since conventional internal combustion engines adopt an intermittent expulsive combustion system wherein the propagating speed of combustion is very low, it will become more difficult to make synchronization with their piston as it is operated at a higher speed.

In addition, there have been proposed external combustion engines called "Stirling Engine" suitable for continuous combustion of fuel mixture as in steam engines. However, such stirling engines have the disadvantages that a special heat exchanging mechanism is required and that losses in exhausting and heat conducting are so high as to result in a low thermal efficiency.

SUMMARY OF THE INVENTION

Therefore, it is a main object of this invention to provide a novel internal combustion engine eliminating the above-mentioned defects.

It is another object of this invention to provide an internal combustion engine wherein combustion of air and fuel mixture not stratified, but homogeneously mixed, having a low mixture ratio, for example, below 19:1 can be effected without producing any poisonous exhaust gas.

It is a further object of this invention to provide an internal combustion engine wherein no heat exchanger as would be required in stirling engines, is provided, but operating gas is directly heated, thereby resulting in a very high thermal efficiency.

It is a still further object of this invention to provide an internal combustion engine suitable for high speed operation wherein continuous combustion of fuel mixture is effected.

These and other objects have been achieved by an internal combustion engine comprising a compression and expansion casing having an operating member adapted to cause volumetric compression of fuel mixture and volumetric expansion of combustion gas and a combustion tube in which conbustion of fuel mixture is effected at a constant pressure, said compression and expansion casing including means communicating with the interior thereof for providing fuel mixture thereto, said combustion tube including a constant pressure chamber adapted to communicate with the interior of said compression and expansion casing through a first valve which opens only when the fuel mixture within the compression and expansion casing is in a compressed condition, a combustion-sustaining chamber communicating with said constant-pressure chamber and having an igniter for igniting and sustaining combustion of fuel mixture and a constant-pressure combustion chamber communicating with said combustion-sustaining chamber to cause further complete combustion of the combustion gas from said combustion-sustaining chamber, said constant-pressure combustion chamber being adapted to communicate with the interior of said compression and expansion casing through a second valve which opens only when said operating member of said compression and expansion casing is in an initial portion of its expansion stroke.

BRIEF DESCRIPTION OF THE DRAWINGS

FIG. 5 is a sectional view as taken along the V—V line of FIG. 4;

FIG. 6 is a valve timing chart showing the volume-constant pressure operation of the cylinder and combustion tube of the engine of this invention; and FIG. 7 is a pressure-volume or indicator diagram of the cylinder and combustion tube of the engine of this invention.

DETAILED DESCRIPTION OF PREFERRED EMBODIMENTS

Figure 1:
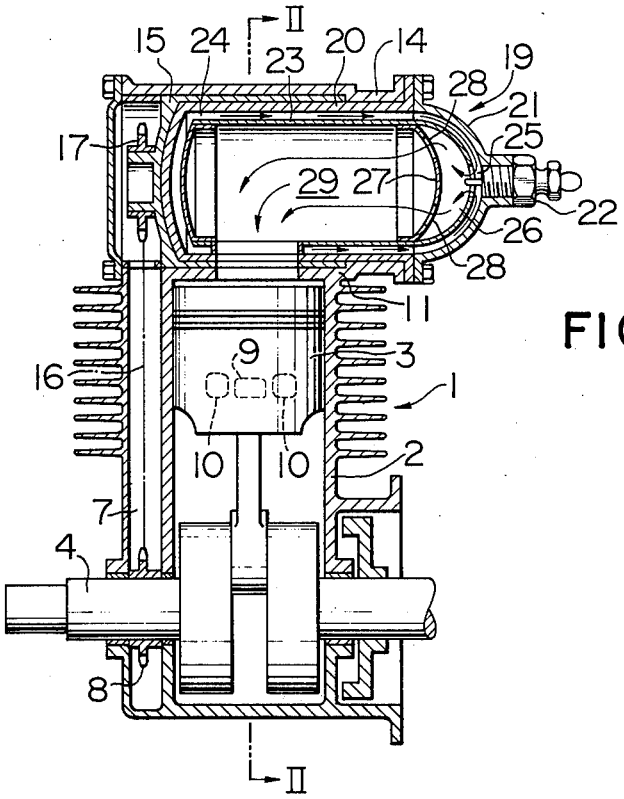
FIG. 1 is a longitudinally sectional view of an embodiment of reciprocating type internal combustion engine according to this invention.
Figure 2:
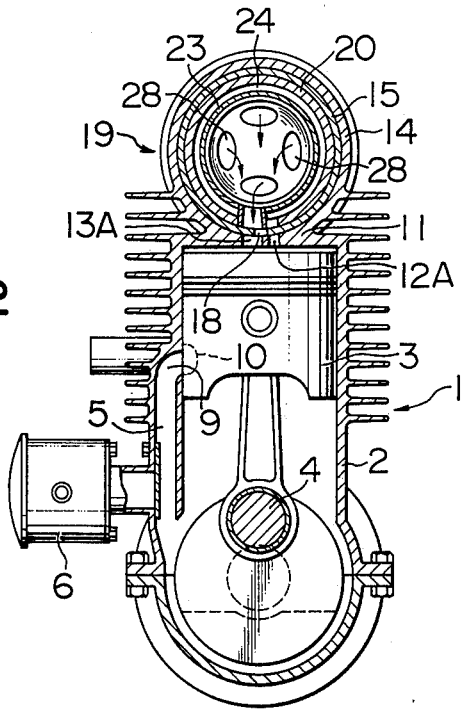
FIG. 2 is a sectional view as taken along the II—II line of FIG. 1.

Referring now to FIGS. 1 and 2, there is illustrated a reciprocating type internal combustion engine according to this invention. The engine comprises an air compression and expansion device 1 consisting of a cylinder 2, a piston 3, a crank shaft 4 and so on, as in conventional 2-cycle internal combustion engines. An intake pipe 5 is connected at its end to a carburetor 6 which may be suitable particularly to provide dilute fuel mixture having a fuel-air ratio lower than that of fuel mixture employed in conventional gasoline engines. A sprocket 8 is fixed to the portion of the crank shaft 4 which is within a chain chamber 7.

The cylinder 2 is provided at adjacent portions of its side wall with a suction port 9 and exhaust ports 10 and at adjacent portions of its top wall 11 with a pressure-feeding inlet valve aperture 12A to allow passage of compressed fuel mixture and a pressure-feeding outlet valve aperture 13A to permit passage of combustion gas. The cylinder 2 is also provided on its top wall 11 with a rotary valve tube 14.

A rotary valve 15 is closely fitted into the rotary valve tube 14. The rotary valve 15 is provided at one end thereof with a sprocket 17 which is engaged with a timing chain 16 engaging with the sprocket 8 fixed to the crank shaft 4. The rotary valve 15 can be rotated in synchronization with the rotation of the crank shaft 4. The rotary valve 15 is also provided at its side wall with a valve aperture 18.

Figure 3:
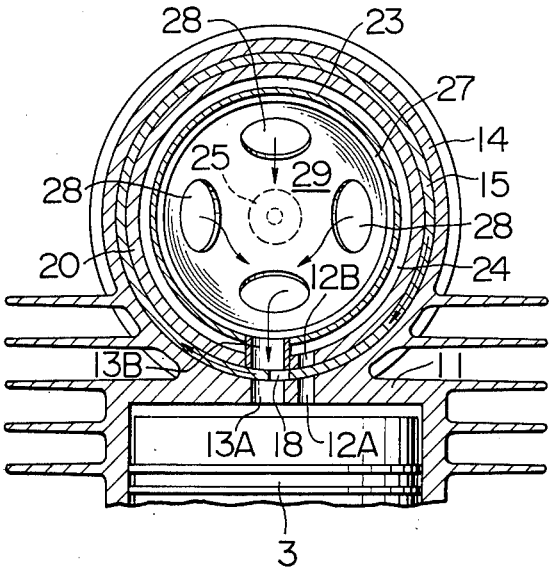
FIG. 3 is an enlarged view of a portion of the engine of FIG. 2.

An outer tube or cylindrical combustion tube 20 of a constant-pressure combustion past 19 is closely fitted into the rotary valve 15. The outer tube 20 is fixed at one end thereof to one end of the rotary valve tube 14 together with the head 21 of the constant-pressure combustion part. The head 21 is provided with an igniter 22, as shown best in FIG. 1. An inner tube or cylindrical convection tube 23 is concentrically disposed within the outer tube 20 and the head 21 to define a fuel mixture chamber 24 between the outer surface of the tube 23 and the inner surfaces of the outer tube 20 and the head 21, the volume of which chamber 24 is very small as compared with the whole surface area thereof. As shown best in FIG. 3, the outer tube 20 is provided at its side wall with a pressure-feeding inlet valve aperture 12B which is opposed to the pressure-feeding inlet valve aperture 12A of the cylinder to wall 11 and opens to the fuel mixture chamber 24. A pressure-feeding outlet valve passage 13B opening to the interior of the inner tube 23 is provided across the outer tube 20 and the inner tube 23 in a position opposite to the pressure-feeding outlet valve aperture 13A of the cylinder top wall 11. Rotation of the rotary valve 15 will establish a suitable valve timing through a sequential alignment of the valve aperture 18 with the inlet valve aperture 12A of the cylinder top wall 11 and the inlet valve aperture 12B of the outer tube 20, and the outlet aperture 13A of the cylinder top wall 11 and the outlet passage 13B. In this embodiment, the valve area of the pressure-feeding outlet valve 13A, 13B is larger than that of the pressure-feeding inlet valve 12A, 12B.

The inner tube 23 is provided at one end thereof with a combustion chamber port 25. The igniter 22 is positioned within the port 25. As illustrated in FIG. 1, the interior of the inner tube 23 is compartmented to a dome-like combustion chamber 26 and a combustion gas chamber 29 by means of a cup-like partition heat radiation plate 27 for heat-retaining. The partition 27 has one or more combustion gas chamber ports 28. The combustion gas chamber 29 is connected to the pressure-feeding outlet valve passage 13B as described before.

In operation, an amount of fuel mixture having at low fuel-air ratio is taken from the carburetor 6 of the air compression and expansion device 1 to the cylinder 2 and then compressed by the piston 3. When the piston 3 approaches the upper limit of its compression stroke and the valve aperture 18 of the rotary valve 15 driven by the crank shaft 4 is in alignment with the pressure-feeding inlet valve apertures 12A and 12B, the compressed fuel mixture is pressure-fed into the fuel mixture chamber 24 through the apertures 12A, 18 and 12B. The compressed fuel mixture then flows through the combustion chamber port 25 into the combustion chamber 26 as shown by arrows in FIG. 1. The low fuel-air ratio mixture which it would be very difficult to ignite can be easily ignited by the igniting effect of the igniter 22 (used only during the starting period of the engine) and the heat retaining effect of the partition 27. In particular, during the starting period of the engine, fuel mixture is ignited by the igniter 22 until sufficiently high temperature combustion gas has been established in the combustion chamber 26 to heat the heat radiation plate 27 so that the resultant heat accumulated in the plate 27 may radiate into the combustion chamber 26 to cause fuel mixture introduced thereinto to be ignited even without the igniting effect of the igniter 22. After that, the igniter 22 can be made inoperative, and combustion of fuel mixture will be maintained only by heat radiation from the heat radiation plate 27. Combustion gas containing incomplete combustion gas from the combustion chamber 26 flows through the ports 28 of the partition 27 into the adjacent combustion gas chamber 29 where further complete combustion will be effected. When the piston 3 of the air compression and expansion device 1 is in an initial portion of its expansion stroke and the valve aperture 18 of the rotary valve 15 is in alignment with the pressure-feeding outlet valve passage 13B and the pressure-feeding outlet valve aperture 13A, an amount of combustion gas which is equal to the amount of combustion gas produced by the combustion of fuel mixture will be pressure-fed into the cylinder 2 through the apertures 13B, 18 and 13A to drive the piston 3 through its expansion thereby to generate an output. After a predetermined time from starting of the engine, the combustion chamber 26 will be maintained at a temperature, for example, about 800° to 1100° C, sufficient to ignite fuel mixture due to the heat-retaining effect of the partition 27. After that, it will become unnecessary to energize the igniter 22. Combustion within the combustion gas chamber 29 will be maintained at, for example about 700° to 1100° C.

The cylindrical convection tube 23 and the heat radiation plate 27 divide the interior of the cylindrical combustion tube 20 into the fuel mixture chamber 24, the combustion tube 26 and the combustion gas chamber 29 to allow fuel mixture to convectively flow through the fuel mixture chamber 24, the combustion chamber 26 and the combustion gas chamber 29, and the heat radiation plate 27 serves to effect combustion of fuel mixture in the combustion chamber 26 by radiation of heat accumulated therein so that convective flow of fuel mixture may be maintained to load to continuous combustion of fuel mixture. Furthermore, in FIGS. 1 and 2, it should be noted that the gap between the inner peripheral wall surface of the cylindrical combustion tube 20 and the out peripheral wall surface of the cylindrical convection tube 23 is small enough to prevent backfire within the convection tube 20, and it is desirable that the combustion chamber 26 has a volume larger than that of the fuel mixture chamber 24, but smaller than that of the combustion gas chamber 29. Since the method and apparatus of the present invention effect combustion of dilute fuel mixture homogeneously mixed in such manner as described above, the combustion temperature can be set by a value lower than that in a conventional engine, whereby any poisonous exhaust gas such as CO and NO is prevented from being produced. However, combustion of fuel mixture at such a low temperature would lead to a decrease in thermodynamic efficiency of the whole of the engine. According to the present invention, such decrease in thermodynamic efficiency will be fully compensated for primarily by (i) setting the compression ratio to a value higher than that in a conventional engine, for example 10:1 so as to reduce exhaust thermal loss (dilute fuel mixture used in the present invention will be suitable for high compression), (ii) surrounding the combustion chamber and the combustion gas chamber, through which high temperature combustion gas flows, by the fuel mixture chamber through which low temperature fuel mixture flows, so as to reduce radiant heat loss, and (iii) setting the maximum combustion temperature to a lower value so as to reduce dissipative heat loss due to thermal conduction. From the foregoings, it will be seen that in the engine of this invention the continuous, but not intermittent combustion of fuel mixture is stably maintained, and therefore the amount of poisonous exhaust gas which would be produced due to the lowering of combustion temperature and so on is extremely reduced even if fuel mixture having a lower mixture ratio is used. Furthermore, according to this invention, since combustion of fuel mixture is continuously effected, the problem of synchronization with the operation of piston will not be needed to be taken into consideration. Therefore, this invention can be applied to high speed piston or rotary engines.

Figure 4:
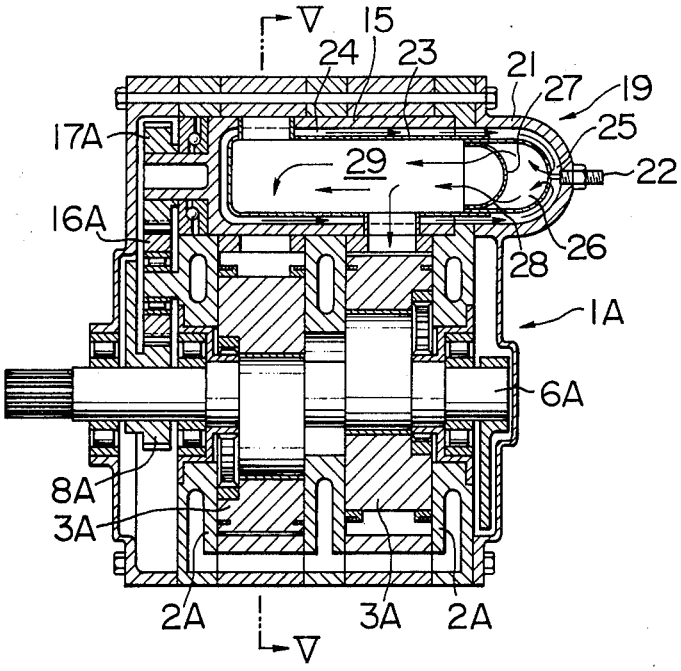
FIG. 4 is a longitudinally sectional view of an embodiment of rotary type internal combustion engine according to this invention.

Referring now to FIGS. 4 and 5, there is illustrated a rotary type internal combustion engine according to this invention. In FIGS. 4 and 5, like components are designated the same reference numerals as used in FIGS. 1 to 3.

In the rotary type engine, there is provided an air compression and expansion device 1A comprising a generally elliptical casing 2A having an intake port 9 and an exhaust port 10 and a generally triangular rotor 3A capable of rotating eccentrically about a main shaft 6A within the casing 2A and having no recess to provide an additional combustion space. A constant-pressure combustion part 19 similar to that in the first embodiment mentioned before is located adjacent the portion of the interior of the casing 2A wherein compression of fuel mixture is effected. In the ending portion of compression stroke of the rotor 3A, fuel mixture is pressure-fed into the constant-pressure combustion part 19, and in the initial portion of expansion stroke of the rotor 3A, combustion gas is pressure-fed into the casing 2A from the combustion part 19 to produce an output from the main shaft 6A. The constant-pressure combustion part 19 includes a rotary valve 15 which can be rotated through a transferring gear 16A and a rotary valve gear 17A by a main shaft gear 8A rotating with the main shaft 6A.

As in the first embodiment as described above, the constant-pressure combustion part 19 is divided into a fuel mixture chamber 24, a combustion chamber 26 and a combustion gas chamber 29 by means of an inner tube 23 and a heat-retaining partition or heat radiation plate 27. An igniter 22 is disposed in the vicinity of an inlet port 25 to the combustion chamber 26.

Operation of this rotary type engine is substantially identical with that of the reciprocating type engine as described before. Since in the rotary type engine of this invention compression of fuel mixture and expansion of combustion gas are effected by a generally triangular rotor without any recesses to provide additional combustion space, there will be no problem of incomplete combustion of fuel mixture which would be caused due to the provision of such recesses in a rotor in conventional rotary engines.

The valve timing and pressure changes of the engine of this invention are indicated by the arrows and symbols in FIG. 7. Reference character *a* indicates suction stroke, *b* compression stroke, *c* opening of pressure-feeding inlet valve, *d* opening of pressure-feeding outlet valve, *e* closing of pressure-feeding inlet valve, *f* closing of pressure-feeding outlet valve, *g* expansion stroke, *h* closing of exhaust valve, and *i* intake of dilute fuel mixture. This engine is operated in the sequence of $i \rightarrow a \rightarrow b \rightarrow c \rightarrow d \rightarrow e \rightarrow f \rightarrow g \rightarrow h$. In FIG. 4, reference character O indicates bottom dead center, O′ top dead center and *j* the mean pressure within the combustion tube.

In the embodiments as described above, the carburetor 6 may provide fuel mixture having a mixture ratio lower than that in conventional engines. Furthermore, gas fuels such as natural gas may be used instead of gasoline. In this case, no carburetor 6 will be required.

I claim:

1. In a combustion powered engine, an apparatus for effecting combustion of fuel gas comprising means for volumetrically compressing a mixture of air and fuel homogeneously mixed without stratification, including an operating member disposed within a casing and movable therein to cause volumetric compression of said mixture and volumetric expansion of combustion gas, means defining a cylindrical volume, means forming an introducing part through which said compressed mixture can be fed from said casing into said cylindrical volume, means defining a mixture chamber where a flow of said mixture can be established along an outer annular layer portion of said cylindrical volume concentric with said cylindrical volume in a direction away from said introducing part, means for receiving said mixture flow and effecting continuous combustion of the mixture by heat radiated from a hot surface and provided at a position within said cylindrical volume and remote from said introducing part, said cylindrical volume defining means including a cylindrical combustion tube provided adjacent of said casing, said mixture chamber defining means including a cylindrical convection tube provided within said cylindrical combustion tube concentrically therewith so as to leave said chamber between the inner peripheral wall surface of said cylindrical combustion tube and the other peripheral wall surface of said cylindrical convection tube, said convection tube having an end open to said mixture chamber, said continuous combustion effecting means including a heat radiation plate provided within said convection tube concentrically therewith so as to divide the inside of the convection tube into a combustion chamber which is in communication with said mixture chamber through said opening end of said convection tube and a combustion gas chamber, said heat radiation plate being heated by combustion gas in said combustion chamber, whereby the resultant heat accumulated therein radiates into said combustion chamber to ignite fuel and air mixture introduced into said combustion chamber, combustion gas chamber ports provided in said heat radiation plate, said introducing part forming means including an aperture provided in the wall of said combustion tube to allow said mixture chamber to communicate with said casing, and outlet part forming means comprising an aperture provided in the wall of said convection tube to allow said combustion gas chamber to communicate with said casing, and including a rotary valve provided concentrically with said combustion tube to serve to allow compressed mixtue to be introduced into said mixture chamber through said aperture of said combustion tube from said casing only when said operating member in said casing is in an ending portion of its compression stroke and to allow combustion gas to flow into said casing through said aperture of said convection tube from said combustion gas chamber only when said operating member in said casing is in an initial portion of its expansion stroke, whereby a constant pressure can be maintained in said fuel and air mixture chamber.

2. A combustion powered engine according to claim 1 wherein the gap between the inner peripheral wall surface of said cylindrical combustion tube and the outer peripheral wall surface of said convection tube is small enough to prevent backfire within said convection tube.

3. A combustion powered engine according to claim 1 wherein said combustion chamber has a volume larger than that of said fuel mixture chamber, but smaller than that of said combustion gas chamber.

* * * * *